United States Patent [19]

Page, Jr.

[11] 4,069,871

[45] Jan. 24, 1978

[54] DEEP WELL SAFETY VALVE

[76] Inventor: John S. Page, Jr., 10424 Echo River Court, Fountain Valley, Calif. 92708

[21] Appl. No.: 749,825

[22] Filed: Dec. 13, 1976

Related U.S. Application Data

[63] Continuation-in-part of Ser. No. 567,376, March 11, 1975, Pat. No. 4,005,751.

[51] Int. Cl.[2] ..... E21B 43/12

[52] U.S. Cl. ..... 166/321; 137/458; 166/324

[58] Field of Search ..... 166/72, 321–324; 137/458, 492.5; 251/26, 28, 29, 62, 63

[56] References Cited

U.S. PATENT DOCUMENTS

| | | | |
|---|---|---|---|
| 3,252,476 | 5/1966 | Page, Jr. | 137/458 |
| 3,361,212 | 1/1968 | Page, Jr. | 166/322 |
| 3,621,881 | 11/1971 | Vicari | 251/28 |
| 3,662,824 | 5/1972 | Page, Jr. | 166/72 |
| 3,863,672 | 2/1975 | Theriot et al. | 137/458 |

*Primary Examiner*—James A. Leppink

*Attorney, Agent, or Firm*—Haefliger, William W.

[57] ABSTRACT

A surface controlled, sub-surface well valve includes a main valve, a main valve actuator, and a control pressure responsive pilot valve to control application of control pressure to the actuator. The construction is such that the effects of excessive control pressure due to well depth are obviated.

27 Claims, 12 Drawing Figures

119
118
107
105
120
113
115
128
133
114
121
122
104
143
142
131
141
130
140
129
123
127
108
117
112
116
126
124a
104a
145
125
144
280
124
137
138
t
246
201
100
101
102
103
100a
104b
109
108a
111
106
110
107

97
95
10b
12
11
60
96
51
13
16
45
43
42
72
27a
34
73
65
46
33
40
37
49
48
27
35
56
19d
29
27a
90
92
32
14
91
26
10a 119
118
107
105
120
113
245
115
128
133
114
121
122
104
143
142
131
141
130
140
129
123
127
117
108
112
116
126
124a
104a
145
125
144
280
124
137
138
201
100
101
102
103
100a
104b
109
108a
111
106
110
107

97
95
10b
12
11
60
96
51
13
16
45
43
42
72
27a
34
73
46
33
40
37
49
48
27
35
56
19d
29
27a
90
92
32
14
91
26
10a

DEEP WELL SAFETY VALVE

BACKGROUND OF THE INVENTION

This application is a continuation-in-part of my prior application Ser. No. 567,376 filed Mar. 11, 1975 now U.S. Pat. No. 4,005,751.

This invention relates generally to controlling the upward flow of production in a well, and more particularly concerns the fluid pressure control from the surface of sub-surface valves, particularly in deep wells, in such manner as to obviate the effects of excessive control pressure due to well depth.

In the past, production flow controlling sleeve valves have been constructed to take advantages of the pressure of the production flow to urge the valve sleeve in one direction between open and closed positions. While this was in certain instances satisfactory, serious problems can arise when the pressure of the production flow varies, as for example can occur with the valve at a fixed installation depth, and also when the valve is moved up or down in the well. For example, if the production flow pressure increases greatly, then it requires much more control pressure to overcome the effect of increased production flow pressure on the valve sleeve, in order to shift the valve sleeve in the opposite direction, or to maintain the valve in open condition, for example. Also, excessive static control pressure tends to maintain the valves open is a problem, particularly in deep wells. These conditions in turn serve to limit the depths at which said sleeve type safety valves can be usefully installed, and also requires monitoring of such valves and adjustments of control pressure application to make sure that they remain in desired open or closed state.

SUMMARY OF THE INVENTION

It is a major object of the invention to provide a surface controlled, sub-surface safety valve characterized in that the effects of excessive control pressure due to well depth are obviated. Basically, the invention is embodied in the combination that includes a. a housing connectible in a well tubing string, the housing having opposite ends, b. a main valve and an actuator therefor, the actuator carried for movement relative to the housing to displace the main valve between open and closed positions to control production fluid flow upwardly relative to the housing, and c. pilot valve means positioned to block application of the control pressure that would act to shift the main valve to open position at certain times when the control pressure exceeds the well fluid pressure, the pilot valve means being shiftable relative to the housing in response to an increase in the control fluid pressure to unblock application thereof acting to shift the main valve to open position at other times when the control pressure exceeds the well fluid pressure.

As will appear, the main and pilot valves may comprise sleeves, which may be supported on a carrier, the latter being wire line retrievable; the main and pilot valves may be pressure balanced or approximately so, and a small control spring may be employed to bias the pilot valve to set the control pressure at which the pilot valve is shiftable to effect opening of the main valve, despite the fact that the control pressure exceeds the production fluid pressure. Further, the use of auxiliary weighting as disclosed in my co-pending application Serial No. 513,470, filed October 9, 1974, may thereby be avoided, whereby a compact, simple, reliable, deep well safety valve (surface controlled) is provided.

The invention is also directed to sub-surface well valve apparatus that includes a main valve to control the upward flow of well production fluid, together with:

a. a sub-surface pilot valve generally vertically spaced in the well from the main valve, b. the pilot valve operable to selectively divert the path of flow of control fluid in response to a change in pressure or fluid applied to the pilot valve.

As will be seen, the pilot valve may be located generally below the main valve, and be responsive to well fluid pressure changes; the pilot valve may comprise a spool movable in a tubular body, the spool releasably latched to the body to be vertically retrievable while the body and main valve remain in the well; and the main valve may be connected to receive control fluid pressure from the pilot valve therebelow. Also, the pilot valve may be vertically spaced between the main valve and a well packer, to cooperate therewith as will be seen. As a result, enlargement of the main valve housing to accommodate the pilot valve is not required, the pilot valve may be centered below the main valve to be axially upwardly retrievable through the main valve while the latter remains in the well; and the production fluid may be directed to flow around the pilot valve and upwardly to the main valve.

These and other objects and advantages of the invention, as well as the details of an illustrative embodiment, will be more fully understood from the following description and drawings, in which:

DRAWING DESCRIPTION

FIGS. 1*a* and 1*b* are vertical half sections showing one form of the invention;

Figure 4:
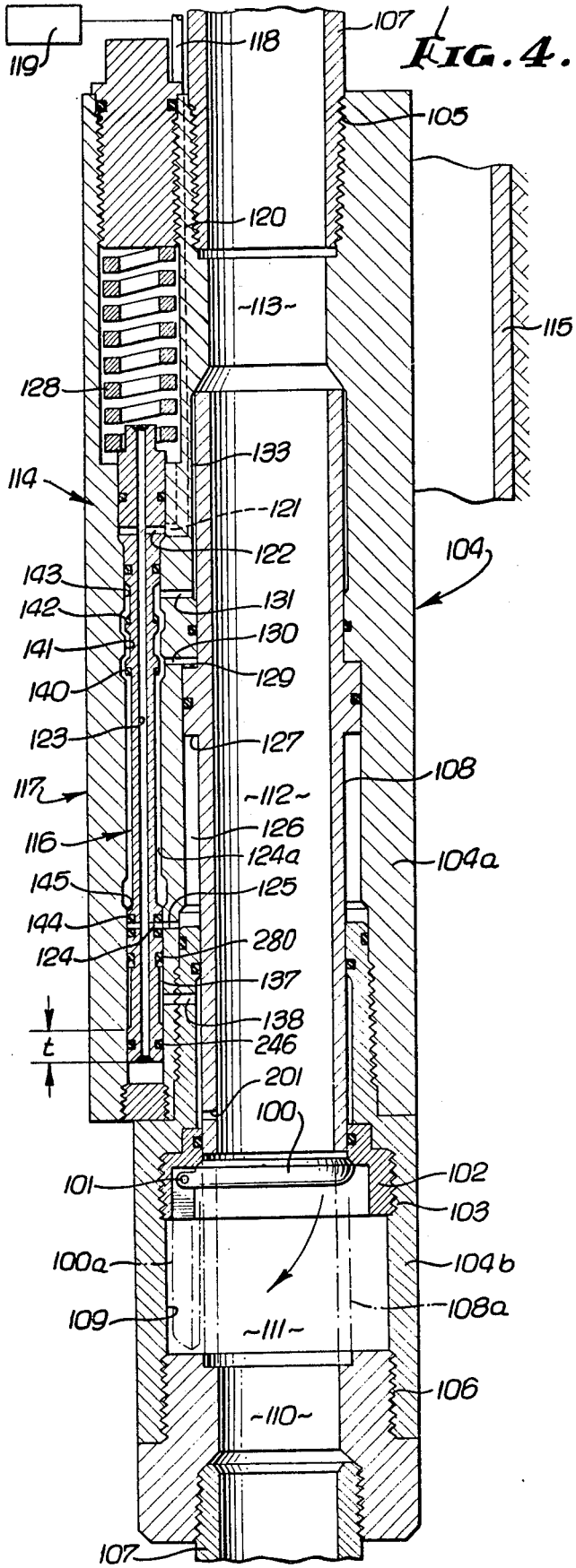
FIG. 4 is a full vertical section showing another form of the invention.
Figure 3:
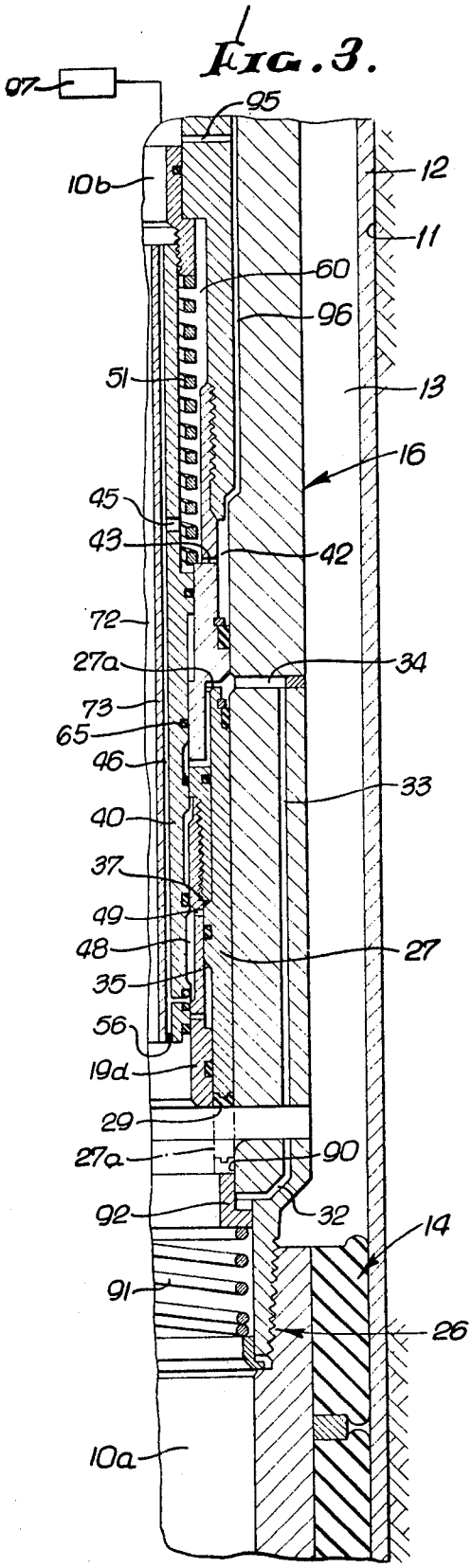
FIG. 3 is a vertical section like FIG. 1*b* but showing a modification.
Figure 4A:
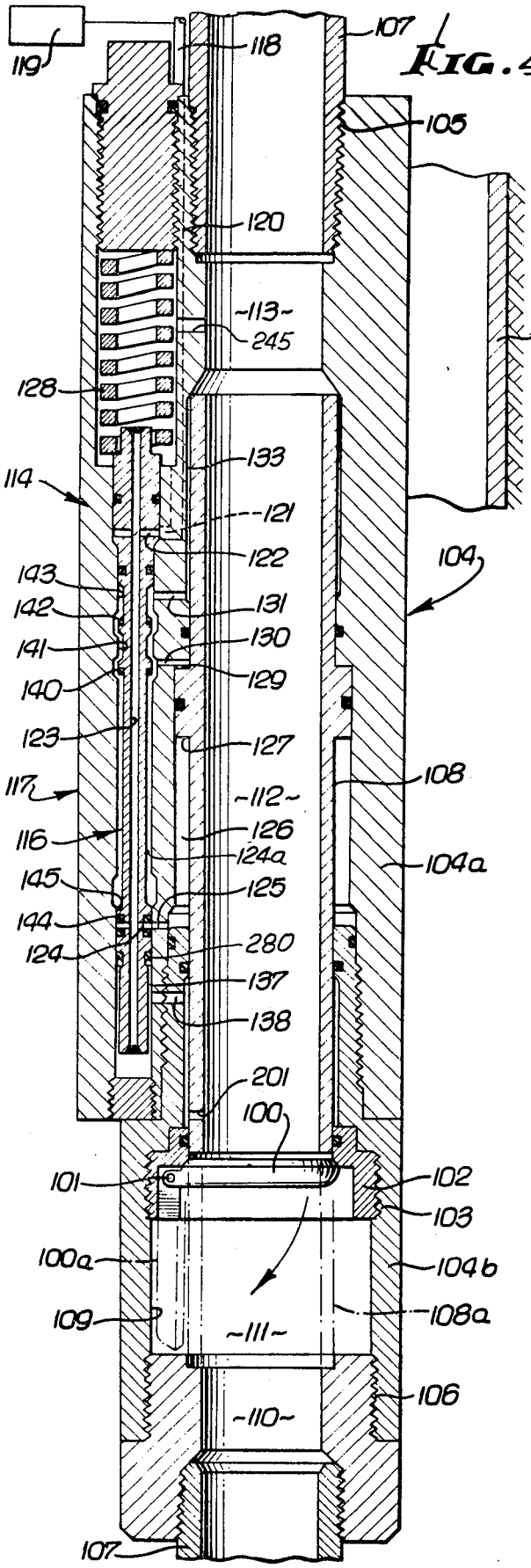
Figure 3A:
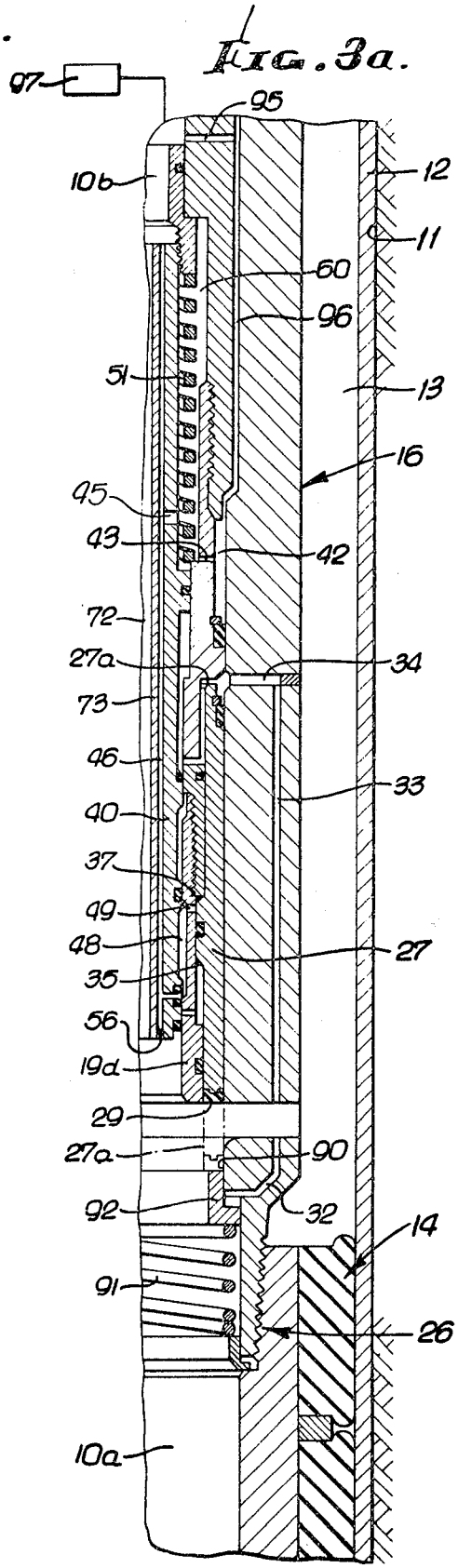
Figure 5:
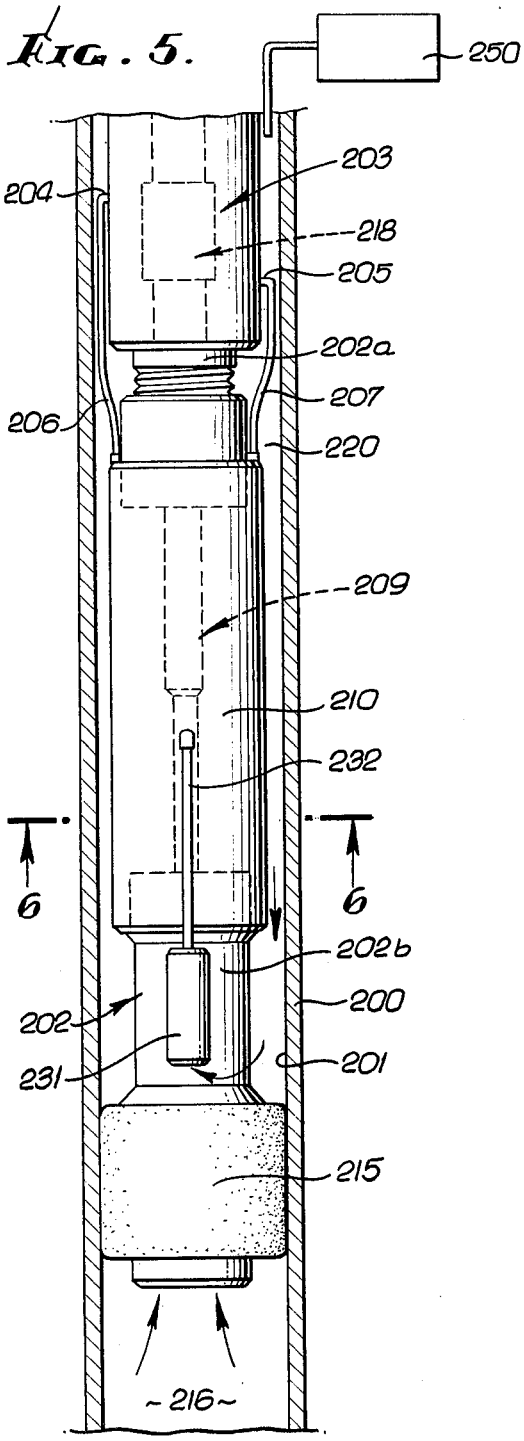
Figure 6:
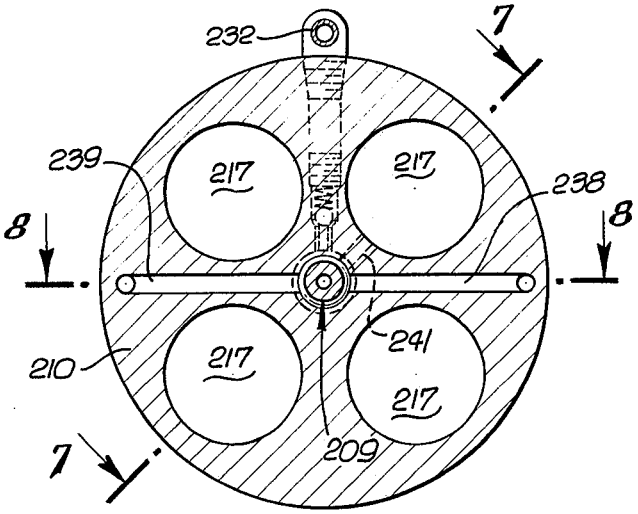
Figure 7:
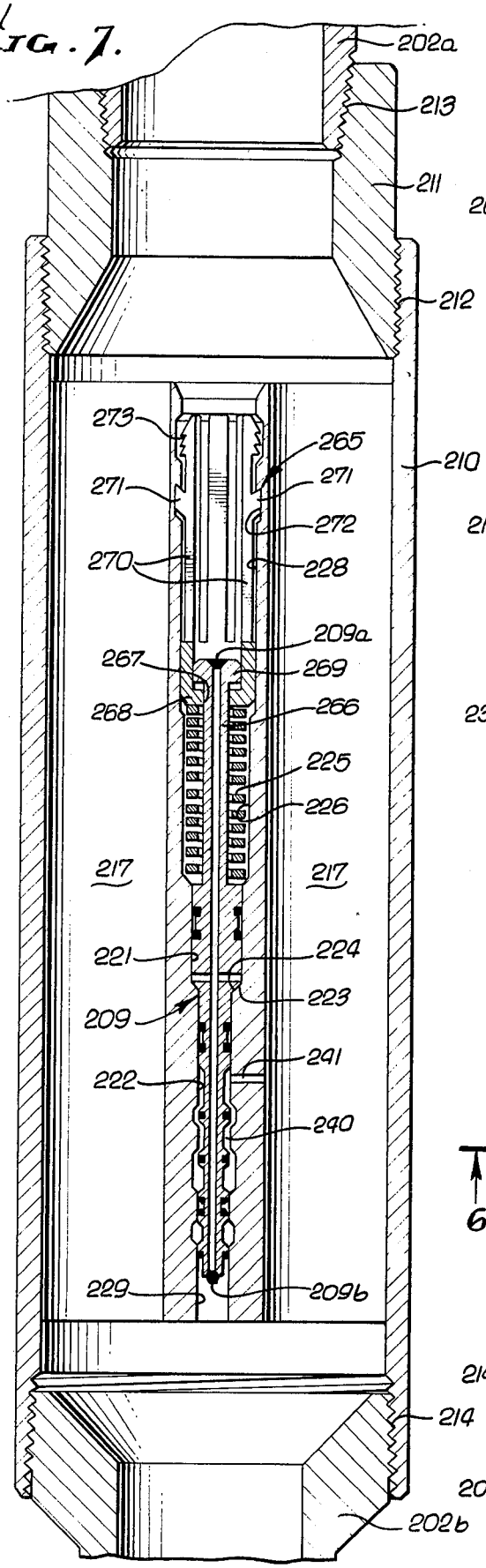
Figure 8:
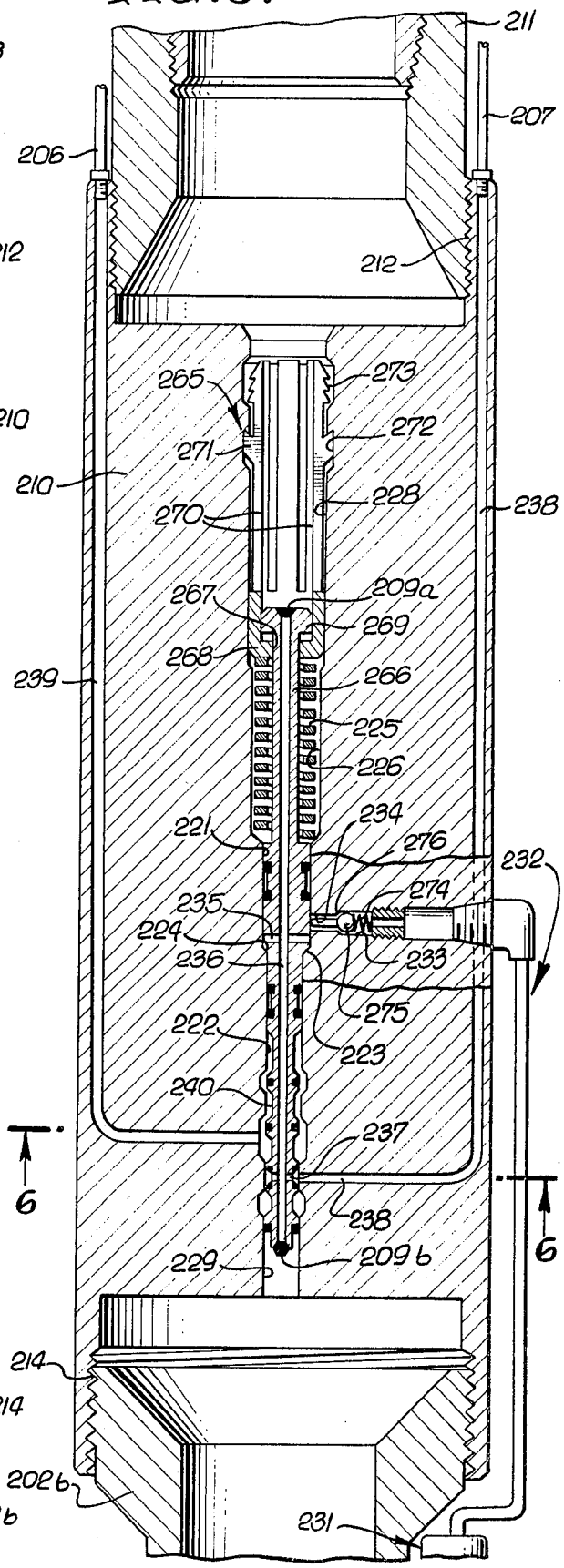

FIGS. 3*a* and 4*a* are views like FIGS. 3 and 4, showing modifications;

FIG. 5 is a vertical section showing yet another form of the invention;

FIG. 6 is a horizontal section on lines 6—6 of FIG. 5 and of FIG. 8;

FIG. 7 is a vertical section on lines 7—7 of FIG. 6;

FIG. 8 is a vertical section on lines 8—8 of FIG. 6; and

Figure 9:
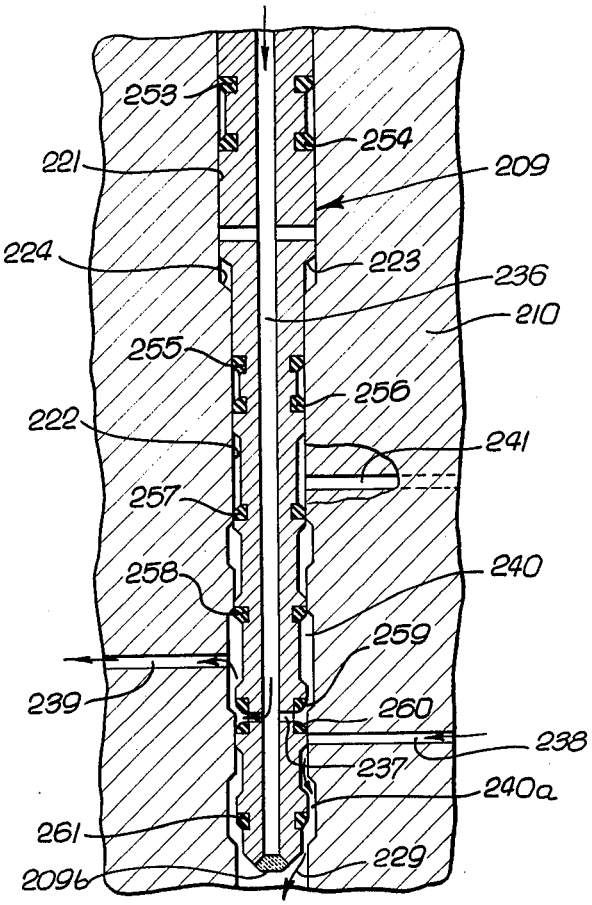

FIG. 9 is an enlarged vertical section showing the pilot valve spool in up-position.

DETAILED DESCRIPTION

Figure 1A:
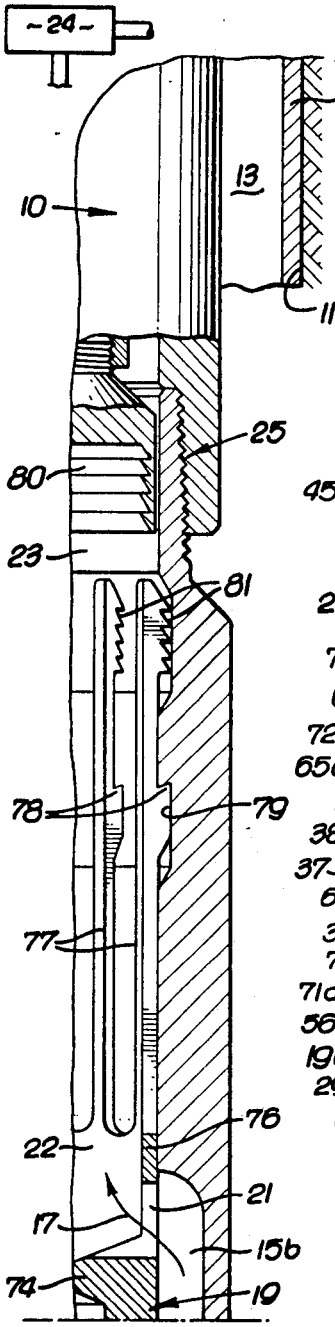
Figure 1B:
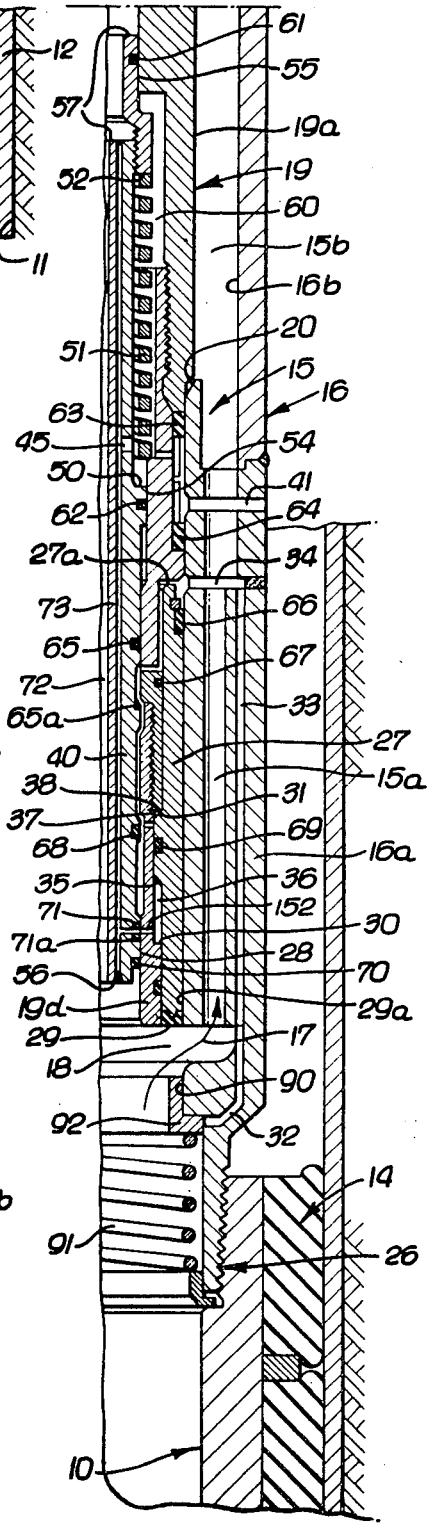

Referring first to FIGS. 1*a* and 1*b*, a tubing string 10 is located in a well 11 provided with casing 12. The annulus 13 between the string and casing is packed off at 14 below the level of a side passage 15 in a valve housing 16 connected in series with the string. In main valve open condition, the upward flow of production fluid in passage 15 is represented by arrows 17. That passage includes, in upward sequence, annularly spaced, vertical openings 15*a* drilled in housing or body section 16*a*, and annular passage extent 15*b* formed between housing inner wall 16*b* and the outer wall 19*a* of an insert tubular carrier 19 recessed into and landed in the housing at shoulder 20. Upper port 21 returns the upward flow from the upper end of the passage extent 15*b* into the housing interior at 22 and the upper tubing string interior at 23 for ultimate collections and distribution at the surface, via means indicated schematically at 24. Accordingly, the valve may be considered a tubing to tubing, sub-surface, surface controlled valve. Note that the housing has upper and lower threaded ends 25 and 26 connected with the tubing.

In accordance with the invention, a main valve is carried for movement relative to the housing between open and closed positions to control production fluid flow between opposite ends of the housing, as via passage 15. The main valve may with unusual advantage comprise a sleeve 27 carried by the removable carrier 19 for movement between up position shown in solid lines, in which annular port 18 is open, and down position shown by broken lines 27*a* in FIG. 2, in which port 18 is then closed.

The main sleeve valve 27 is slidably carried at 28 by the lower stem 19*d* of the carrier, and an annular seal 29 at the lower end of the sleeve valve packs off between that stem and the housing inner wall 29*a*, in up position of that valve. Note that shoulders 30 and 31 associated with stem 19*a* limit up and down stroking of the main valve 27. Also, the main valve is flow pressure balanced, as by exposing vertically opposite end surfaces to production fluid pressure. Thus, lower end surface or seal 29 is exposed to flow pressure, and the upper end surface at 27*a* is exposed to pressure communicated via ports 32, 33 and 34. For actuating the main valve, piston surface 35 thereon receives control fluid pressure communicated to chamber 36 to displace the valve upwardly, and piston surface 37 receives control fluid pressure communicated to chamber 38 to displace the valve downwardly. Surfaces 35 and 37 may be considered as an actuator for the main valve, whatever form the latter may take.

Further in accordance with the invention, pilot valve means is positioned to block application of the control pressure that would act to shift the main valve to open position at certain times when the control pressure exceeds the well fluid pressure, the pilot valve means being shiftable relative to the housing in response to an increase in control pressure to unblock application thereof acting to shift the main valve to open position at other times when the control pressure exceeds the well fluid pressure.

Figure 2:
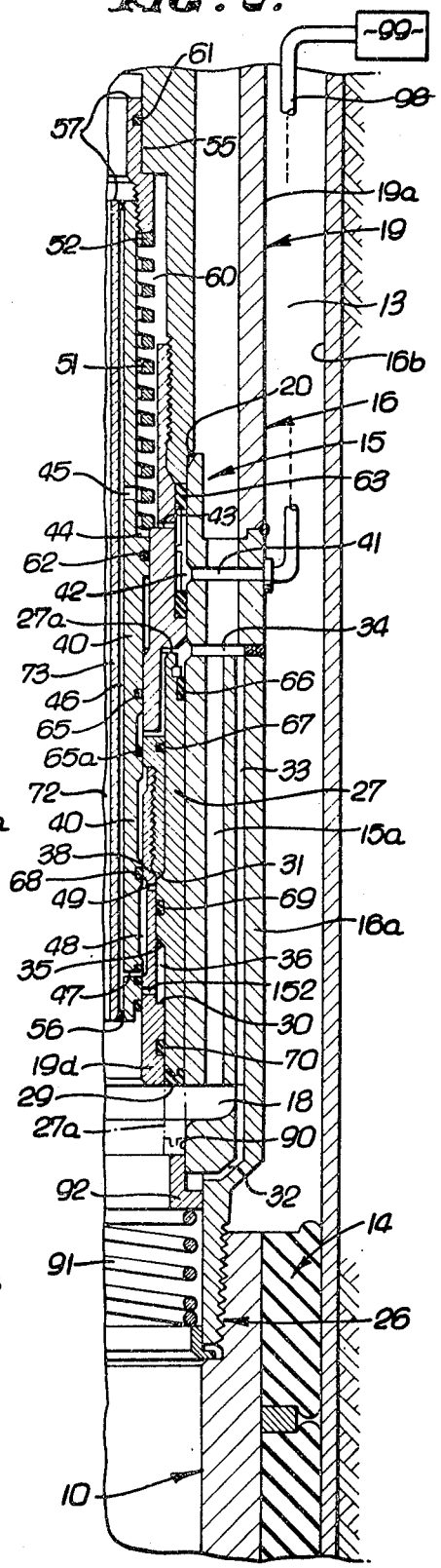
FIG. 2 is a vertical half section like FIG. 1*b* showing a shifted pilot valve condition.

In the example, the pilot valve means comprises a vertically movable sleeve 40 having an up-position as seen in FIG. 2 in which control fluid pressure is communicated to the main valve 27 tending to displace it to closed position. For this purpose, control pressure may be transmitted via side port 41 in the housing to the main valve piston surface 37 via passages 42 and 43, chamber 44, port 45, passage 46 and port 47, passage 48 and port 49 to chamber 38. In this regard, control pressure may be supplied in the annulus 13 by pressurizing same, or via a single control line 98 communicating with a pressure source 99 at the surface. The pilot valve sleeve 40 also has down-position as seen in FIG. 1*b* in which control pressure is communicated to the main valve 27 tending to displace it to up or open position. For this purpose control pressure may be transmitted via passages and ports 41 to 47 to port 152 in carrier extent 19*d*, and then to the chamber 36 and main valve piston surface 35.

The pilot valve has a first piston surface as at 50 to receive application of control pressure to shift the pilot valve to down position when the control pressure exceeds a predetermined level P. In this regard, compression spring 51 is typically employed to normally urge the pilot valve into up-position, the spring sized to be overcome when the control pressure exceeds the predetermined level P. The pilot valve also has a second piston surface, as at 52, to receive application of control pressure tending to shift the pilot valve toward up-position. In this regard, the control pressure receiving effective area of the first piston surface exceeds the control pressure receiving effective area of the second piston surface, this relationship corresponding to the fact that the outer diameter $d_1$ of the pilot valve surface at 54 exceeds the outer diameter $d_2$ of the pilot valve at 55. Note that spring 51 is located in the chamber 60 formed between the pilot valve sleeve and the carrier 19, and exposed to control fluid pressure at ports 41–44.

The pilot valve also has oppositely facing surfaces as at 56 and 57 exposed to receive production fluid pressure, the effective areas of such surfaces being equal so that the pilot valve is also pressure balanced with respect to production fluid pressure.

Additional structure in FIGS. 1*b* and 2 includes seals 61–71, as shown, enabling isolation of control fluid pressure from production fluid pressure. The latter gains access to pilot valve surface 57 via a bore 72 in a tube 73 attached at both ends to the pilot valve 40 to isolate port 46 from production fluid. The carrier end wall 74 acts as a plug blocking off the interior of the tubing above the carrier from the tubing interior below the carrier. The carrier is supported by a collet 76 having spring fingers 77 releasably attached to the housing or sub 16. For this purpose, the fingers may have latches 78 receivable within annular grooving 79 in the housing, the latching engagement occurring upon downward landing of the carrier within the housing. A pulling tool 80 may be lowered into the string via wire line to engage the external serrations 81 on the upper extrusions of the spring fingers. In this process, the fingers are cammed inwardly to unlatch them from the grooving 79, and the carrier 19 may thereby be upwardly retrieved, whereby the well may be produced through the string.

In operation of the pilot and main valves, assume first that the main valve is in FIG. 2 closed position, that the well is sufficiently deep (say, 7,000 feet for example) and that the production fluid static pressure is, say 3,000 psi. Assume also that the control pressure is greater than the production fluid pressure, but not sufficient to shift the pilot valve downwardly. As the control pressure is increased, as by operation of means 99 at the surface, for example, it will reach a level (say 4,000 psi) which is sufficient to overcome spring 51 and shift the pilot valve downwardly to FIG. 1*b* position, allowing control pressure to reach the main valve piston surface 35 to shift that valve upwardly as shown in FIG. 1*b*, opening passage 15 for by-passing production flow from the tubing below the valve to the tubing above the valve. The above specific valves are illustrative only.

Of advantage is the fact that the invention allows the static control pressure to exceed production fluid pressure, with the main valve remaining closed until such time as the control pressure is increased to an even higher and predetermined level. This allows use of the valve in deep wells, and overcomes problem with prior valves wherein the valve would open if the static control pressure exceeded the production fluid pressure. Another advantage lies in the use of a relatively small spring 51 as compared with prior valves wherein a large spring was required to bias the main valve.

It is clear from what has been said that the valve may be used in many different well depths environments, since the pilot valve may be opened or closed to control the main valve irrespective to the production fluid pressure.

Referring again to certain seals, one-way seal 65*a* is used to prevent well pressure from leaking downwardly in FIG. 2 toward and past seal 68 and then out port 152 to chamber 36, and/or to passage 46 and ports 45 and 46 to the annulus or control line; seal 68 is a one-way seal to prevent pressure from passing upwardly in FIG. 2; seals 71 and 71*a* respectively block pressure passage upwardly and downwardly in FIG. 1; and seal 70 blocks upward pressure passage, while allowing excess fluid in chamber 36 to be forced downwardly into the well. Seal 70 may be a U-shaped cup type seal.

It should also be noted in FIGS. 1*b* and 2 that when the main valve 27 is in down or closed position, the annular seal 29 at its lower end engages or wipes the sideward facing annular sealing surface 90 on the housing, and when the main valve is in up or open position, a compression spring 91 urges a sleeve 92 upwardly adjacent that surface 90. Valve 29 pushes the sleeve downwardly, in FIG. 2.

Turning to FIG. 3, the construction is the same as in FIGS. 1 and 2, except for certain structural variations which enable operation of the valve in tubing to annulus flow mode. Thus, the valve main sleeve 27 controls upward production flow from the tubing interior 10*a* below the valve to the annulus 13. In this regard, elements which are the same as those in FIGS. 1 and 2 are given the same identifying numbers.

Control pressure is exerted downwardly from the tubing interior 10*b* above the valve, to operate the pilot valve. Thus, for example, control pressure is communicated to passages 42 and 43, for purposes as explained above, via radial passage 95 in the carrier, and longitudinal passage 96 formed between the carrier and housing 16. A surface source of control pressure (corresponding to that at 99 in FIG. 2) is indicated at 97.

In the modification seen in FIG. 4, the main valve comprises a flapper 100 pivotally connected at 101 to an insert 102 having threaded connection at 103 to section 104*b* of the housing or sub 104. The latter is connected at 105 and 106 to the tubing string 107. A valve actuator sleeve 108 is movable from up position as shown in full lines to down position as shown broken lines 108*a* to swing the flapper downwardly and sidewardly to broken line position 100*a* in a recess 109 formed by housing section 104*b*. As a result, a vertically open straight passage is formed by the bores 110, 111, 112 and 113, as shown, to pass production flow, sand, rocks, etc., upwardly and without restriction in the tubing. The latter extends vertically within well casing 115.

The main valve actuator sleeve 108 is controlled by a pilot valve unit 114, in a manner somewhat similar to that described above in FIGS. 1 and 2; however, in this case the pilot valve itself comprises an elongated tubular spool 116 movable vertically within an auxiliary housing 117 attached to the side of the main housing 104 so as not to interfere with the main flow passage provided by bores 110–113 as described above. In the "down" spool position shown, control pressure exerted downwardly via a single control line 118, as from a surface source 119, passes via ports 120–122 to the vertical bore 123 in the spool 116. The pressure then passes via side port 124 in the spool and side port 125 in the housing section 104*a* to a lower chamber 126. Pressure in that chamber is exerted upwardly against downward facing piston surface 127 on the actuator 108, shifting the actuator to up-position. Fluid trapped above upward facing piston surface 129 vents to the bore 113 via passages 130–133. Under the latter condition, the flapper valve 100 may be urged to up or closed position, as by a torsion spring, not shown. Control line 118 may be attached to tubing 107.

A "regulating" compression spring 128 within housing 117 urges the pilot valve spool to "down" position, as shown. When the control pressure is increased to a predetermined level, the spool 116 is shifted upwardly by an amount indicated at "*t*" to cause control pressure to be communicated via side port 124 in the upwardly shifted spool to passage 124*a*. From the latter, pressure is communicated via port 130 to the chamber above upward facing piston surface 129 of the actuator sleeve 108, driving that sleeve downwardly to displace the flapper to open position. Fluid trapped in lower chamber 126 then flows via side port 125 past the one way seal 280 and out port 138 to the bore 112, via port 201. In spool up-position, annular seal 140 seals off against bore 141; annular seal 142 seals off at bore 143; and annular seal 144 becomes unsealed off bore 145.

FIGS. 3*a* and 4*a* are like FIGS. 3 and 4, respectively and bear the same numbers which applicable; however, in FIGGS 3 and 4 the pilot valves are well pressure balanced, whereas in FIGS. 3*a* and FIG. 4*a* the pilot valves are not well pressure balanced. Note in this regard the lack of a seal corresponding to seal 65 in FIG. 3; note also the inclusion of port 245 in FIG. 4*a*, and the absence in FIG. 4*a* of a seal corresponding to seal 246 in FIG. 4.

Referring now to FIGS. 5–9, a well casing 200 has a bore 201 into which a tubing string 202 is received. The string may include tubing sections 202*a* and 202*b*, as well as string sections above and suspending a main valve body 203. The main valve within the body 203 may comprise a flapper, as for example was described at 100, or a rotary ball. Piston and sleeve mechanism to operate the main valve may be conventional, or may take the form as described in FIG. 4. In the latter, control pressure introduced at side port 103 drives piston surface 129 down to open the main valve, and control pressure introduced at side port 125 drives piston surface 127 up, and the main valve closes. In FIG. 5, side ports 204 and 205 correspond to ports 130 and 125 of FIG. 4, respectively, and lines 206 and 207 respectively communicate with those ports.

In this form of the invention, a sub-surface pilot valve is generally vertically spaced in the well from the main valve 203, the pilot valve selectively directing the path of flow of control fluid in response to a change in pressure of a fluid applied to the pilot valve. In the example, the pilot valve 209 comprises a spool which is received and vertically movable in a tubular body 210, the latter having connection to the tubing sections. As illustrated in FIG. 7, a tubular adapter 211 has threaded connection at 212 to the body 210, and has threaded connection at 213 to the tubing section 202*a*; and the body has threaded connection at 214 to the tubing section 202*b*. Section 202*a* is connected to the main valve body 203, whereby the pilot valve is located generally below the main valve, and preferably and specifically vertically and coaxially spaced therefrom.

An annular packer 215 may advantageously be carried by the tubing section 202*b* to be spaced below the pilot valve, and to seal off between the tubing section 202*b* and the well bore 201 in FIG. 5. Production fluid flows upwardly from the well zone 216 below the packer into tubing section 202*b*, then upwardly through passage means (as for example circularly spaced vertical through passages 217) in the body 210, then upwardly via tubing section 202*a* to the main valve indicated generally at 218 in body 203. If the main valve is open, production fluid flows to the surface via the upper string sections, not shown.

The main valve is typically connected, as via lines 206 and 207 for example, to receive control fluid from the pilot valve, whereby control pressure urges the main valve toward a first position in response to a decrease in fluid pressure applied to the pilot valve, and toward a second position in response to an increase in fluid pressure applied to the main valve. As will be seen, the control pressure applied to the main valve via the pilot valve may be the same as the fluid pressure applied to the pilot valve to operate it. For example, the control fluid pressure used for this purpose is in the annulus 220 about the pilot and main valves, but above the packer, i.e. isolated from well production fluid flowing upwardly through the pilot main valve and pilot valve body.

Referring to FIGS. 7–9, the pilot valve spool is relatively vertically movable in the bores 221 and 222 of body 210 and between predetermined positions, as for example down position in FIGS. 7–8, and up position seen in FIG. 9. Frusto-conically tapered shoulder 223 on the spool lands on the frusto-conically tapered seat 224 (formed between bores 221 and 222) on the body to limit down movement of the spool. Shoulder 223 also functions as a piston surface. As will appear, the shoulder or piston surface 223 receives application of fluid pressure (as for example control fluid pressure from the annulus) to shift the pilot valve up when the applied fluid pressure exceeds a predetermined level. A coil spring 225 received in body counterbore 226 urges the pilot valve in a direction opposite of that of such shifting, i.e. downwardly in the illustrated embodiment, the spring sized to be overcome when the fluid pressure applied to the piston surface 223 exceeds the predetermined value. The spring tension (adjustable by use of different springs) controls the predetermined value at which shifting occurs. Note that the spool carries opposite end surfaces 209*a* and 209*b*, which face oppositely, and are exposed to or accessible to well production fluid pressure, whereby the spool is pressure balanced, except for piston surface 223. Bores 228 and 229 in the body provide such access.

Basically, and as previously brought out, the pilot valve blocks application of control pressure (to the main valve) that would act to shift the main valve to open position at certain times when the control pressure (in the annulus, for example) exceeds the well production fluid pressure; and it is shiftable (upwardly for example) in response to an increase in the fluid pressure applied to piston surface 223 to unblock application of control pressure acting to shift the main valve to open position at other times when the control pressure exceeds the well fluid pressure.

In the configuration shown in FIG. 8, the pilot valve is in down position as when the pressure of fluid in the annulus is lowered to, or is below the level established by spring 225. Under this condition, annulus fluid is communicated via filter 231 and line 232 and ports 232–234 to spool body bore 221; it then is communicated via ports 235–237 in the spool to port 238 in body 210; it then is communicated to line 207 and to the main valve, to close that valve. Fluid exhausted from the opposite side of the main valve piston flows via line 206 to port 239 in body 210 to the chamber 240 defined by spool body bore 222, and from that chamber the exhausting fluid returns to the well production flow, as via port 241 in body 210 communicating with a passage 217.

In the configuration as seen in FIG. 9, the pilot valve is shifted to up-position, as when the pressure of fluid in the annulus is elevated to, or is at a level above that established by the control spring 225. To this end, means 250 at the surface (see FIG. 5) may be used to pressure fluid in the annulus. Under this condition, annulus fluid is again communicated to piston surface 223, elevating the spool; the pressure then is transmitted via ports 235–237 to chamber 240, and thence to port 239 and line 206 to the main valve to open the latter. Fluid exhausted from the main valve returns via line 207, port 238 into chamber 240*a* and to exit at 229 to the well fluid. Appropriate annular seals 253–261 are carried by the spool to seal off against the body as shown in FIGS. 9 and 10.

Latching structure is carried by the spool to releasably latch to the body 210, so at to enable upward retrieval of the spool from the body while the latter remains in the well, along with the main valve. Such latching structure may include a collet 265 to which the spool is attached, as by extension of the spool spindle 266 through an opening 267 in the foot 268 of the collet. A head 269 on the spindle seats on the collet foot when the collet is pulled upwardly to pull the spool from the body. The collet includes spring fingers 270 carrying latch dogs 271 that fit in an annular groove 272 in the body. When a pulling tool (not shown) is received down over the upper tapered and serrated ends 273 of the fingers, the latter are cammed inwardly to release the dogs from the groove, to enable upward pulling of the spool. As the spool is upwardly removed, a spring 274 urges a ball crank 275 against a seat 276, to block escape of annulus fluid into the bores 221 and 222 and thence to the well production fluid.

In FIGS. 5–9 the pilot valve might alternatively be located in a side pocket in the housing, so as to enable well tools (or well production fluid) to be passed through the main valve, without restriction.

I claim:

1. In sub-surface well valve apparatus that includes a main valve to control the upward flow of well production fluid, the combination that comprises a. a sub-surface pilot valve generally vertically spaced in the well from the main valve, b. the pilot valve operable to selectively divert the path of flow of control fluid in response to a change in pressure of a fluid applied to the pilot valve, c. there being a tubular body and the pilot valve selectively movable in said body, the body carrying a first port communicating with the pilot valve and to which control fluid pressure is passed when the pilot valve is in one axial position, thereby to communicate said pressure to the main valve to move the main valve in one mode, the body carrying a second port communicating with the pilot valve and to which control fluid pressure is passed when the pilot valve is in another axial position, thereby to communicate said pressure to the main valve to move the main valve in another mode, d. said apparatus defining a duct communicating with said pilot valve and via which control fluid pressure passes to the pilot valve for selective passage to the first or second ports.

2. The combination of claim 1 wherein the main valve is connected to receive control fluid from the pilot valve, whereby control pressure urges the main valve toward a first position in response to a decrease in fluid pressure applied to the pilot valve, and toward a second position in response to an increase in fluid pressure applied to the pilot valve.

3. The combination of claim 2 wherein the pilot valve is located generally below the main valve to be responsive to well fluid pressure changes.

4. The combination of claim 2 wherein the pilot valve is vertically and coaxially spaced from the main valve.

5. The combination of claim 1 including a tubular body and wherein the pilot valve includes a spool selectively vertically movable in the body and between predetermined positions.

6. The combination of claim 5 including latching structure carried by the spool and releasably latchable to the body to be upwardly retrievable from the body while the body remains in the well.

7. The combination of claim 1 wherein main valve is operatively connected to the pilot valve, the pilot valve being positioned to block application of control pressure that would act to shift the main valve to open position at certain times when the control pressure exceeds the well fluid pressure, the pilot valve being shiftable in response to an increase in the fluid pressure applied thereto to unblock application of control pressure acting to shift the main valve to open position at other times when the control pressure exceeds the well fluid pressure.

8. The combination of claim 7 wherein the pilot valve has a first piston surface to receive application of fluid pressure to shift the pilot valve as aforesaid when the fluid pressure applicable thereto exceeds a predetermined level.

9. The combination of claim 8 including a spring urging the pilot valve in a direction opposite to that of said shifting, the spring sized to be overcome when said fluid pressure applicable to the pilot valve piston surface exceeds said predetermined level.

10. The combination of claim 1 wherein the pilot valve body is spaced vertically in the well from the main valve, the body containing vertical passage means to pass well production fluid, said passage means communicating vertically with the main valve.

11. The combination of claim 10 wherein said passage means includes multiple passages spaced about the pilot valve.

12. The combination of claim 10 including well tubing extending below the pilot valve, and a packer surrounding said tubing below the pilot valve a seal off between the tubing and a well bore, the tubing communicating with said passage means to pass well fluid upwardly thereto.

13. The combination of claim 1 including means supporting the pilot valve for upward retrieval through the main valve.

14. The combination of claim 13 wherein said last named means includes a tubular body, and a collet supporting the pilot valve for endwise movement relative thereto and within a bore defined by the body, the collet having spring fingers with latching dogs removably urged into a groove in said bore.

15. In sub-surface well valve apparatus that includes a main valve to control the upward flow of well production fluid, the combination that comprises a. a sub-surface pilot valve generally vertically spaced in the well from the main valve, b. the pilot valve operable to selectively divert the path of flow of control fluid in response to a change in pressure of a fluid applied to the pilot valve, c. there being a tubular body and the pilot valve including a spool selectively vertically movable in the body and between predetermined positions, the spool carrying oppositely facing surfaces exposed to well pressure.

16. In sub-surface well valve apparatus that includes a main valve to control the upward flow of well production fluid, the combination that comprises a. a sub-surface pilot valve generally vertically spaced in the well from the main valve, b. the pilot valve operable to selectively divert the path of flow of control fluid in response to a change in pressure of a fluid applied to the pilot valve, c. the main valve being operatively connected to the pilot valve, the pilot valve being positioned to block application of control pressure that would act to shift the main valve to open position at certain times when the control pressure exceeds the well fluid pressure, the pilot valve being shiftable in response to an increase in the fluid pressure applied thereto to unblock application of control pressure acting to shift the main valve to open position at other times when the control pressure exceeds the well fluid pressure, d. the pilot valve having a first piston surface to receive application of fluid pressure to shift the pilot valve as aforesaid when the fluid pressure applicable thereto exceeds a predetermined level, there being a spring urging the pilot valve in a direction opposite to that of said shifting, the spring sized to be overcome when said fluid pressure applicable to the pilot valve piston surface exceeds said predetermined level, the pilot valve having a second and oppositely facing surface exposed to receive well fluid pressure.

17. In combination, a. a tubing string in a well, b. a main valve in said string to control flow of production fluid therethrough, c. a pilot valve in the well operatively connected with the main valve to control operation thereof between open and closed positions, the pilot valve vertically spaced below the main valve, d. and a packer carried by the tubing string below the pilot valve to seal off against a well bore.

18. The combination of claim 17 including a body in the string within which the pilot valve is vertically movable, the body containing passage means to pass well production flow upwardly through the tubing past the pilot valve, there being wire line retrievable latching structure connected to the pilot valve and located thereabove.

19. The combination of claim 18 wherein the pilot valve is operable in response to changes in control fluid pressure application thereto, there being ducting to communicate said control fluid to the pilot valve via the annulus about the string and above the packer.

20. For use in controlling a main valve connected in a sub-surface well tubing string, the combination comprising a. a tubular body connected in the string, b. and a pilot valve spool movable axially vertically in said body, the spool carrying oppositely facing surfaces exposed to well fluid pressure, and c. the pilot valve having a piston surface to receive application of pressure operable to shift the spool in a vertical direction against force exerted by yieldable means carried by the body.

21. In a well valve, a. housing connectible in a well tubing string, b. main valve means and an actuator therefor, the actuator carried by the housing for movement between main valve open and closed positions thereby to control the upward flow of production fluid in the well, c. pilot valve means carried by the housing for movement between two positions in one of which control fluid pressure is passed to effect movement of the main valve means to open position, and in the other of which such passage of control fluid pressure is blocked, d. there being regulator means resisting movement of the pilot valve means to said one position until such time as the control fluid pressure is increased to predetermined level, e. the pilot valve having two oppositely facing surfaces exposed to well fluid pressure.

22. The valve of claim 21 wherein the pilot valve is located interiorly of the housing.

23. The valve of claim 22 wherein the housing is tubular, and including a carrier within the housing and retrievable endwise therefrom, the pilot valve carried by the carrier.

24. The valve of claim 22 wherein the pilot valve is located exteriorly of the housing.

25. The valve of claim 24 including an auxiliary housing carried by said first mentioned housing, the pilot valve located within the auxiliary housing.

26. The valve of claim 25 including a single control line for said control fluid pressure, there being a well tubing string supporting said control line and connected with said housing, in a well.

27. In sub-surface well apparatus that includes a control fluid responsive mechanism, the combination that comprises a. a sub-surface pilot valve located in the well and connected to the mechanism, b. the pilot valve operable to selectively divert the path of flow of control fluid in response to a change in pressure of a fluid applied to the pilot valve, c. the pilot valve having two oppositely facing surfaces exposed to well fluid pressure.

* * * * *